United States Patent [19]

Fricker

[11] Patent Number: 5,042,219

[45] Date of Patent: Aug. 27, 1991

[54] FLAT STEEL ANCHOR FOR PRECAST CONCRETE PIECES

[75] Inventor: Siegfried Fricker, Wiernsheim, Fed. Rep. of Germany

[73] Assignee: Unistrut Europe PLC, Bedford, England

[21] Appl. No.: 480,495

[22] Filed: Feb. 16, 1990

[30] Foreign Application Priority Data

. Feb. 17, 1989 [DE] Fed. Rep. of Germany ..... 3904772

[51] Int. Cl.[5] ..... E04B 1/38

[52] U.S. Cl. ..... 52/707; 52/712

[58] Field of Search ..... 52/707, 712, 677, 684, 52/689

[56] References Cited

U.S. PATENT DOCUMENTS 1,123,107 12/1914 Darr ..... 52/689 X

FOREIGN PATENT DOCUMENTS 3042329 6/1982 Fed. Rep. of Germany .

36828 3/1913 Sweden ..... 52/684

*Primary Examiner*—David A. Scherbel

*Assistant Examiner*—Linda J. Watson

*Attorney, Agent, or Firm*—Foley & Lardner

[57] ABSTRACT

A flat steel anchor for precast concrete parts, with the anchor having at least two hook-shaped bent sections formed in the anchoring area and extending in directions opposite to a vertical plane through a point intermediate the front and back of the anchor. The bent sections are of various shapes and curved downwardly and inwardly to jointly define a continuous opening closed on either side to receive and retain a reinforcing rod.

9 Claims, 6 Drawing Sheets

FLAT STEEL ANCHOR FOR PRECAST CONCRETE PIECES

BACKGROUND OF THE INVENTION

The invention relates to a flat steel anchor for precast concrete parts in which an upper connecting area of the anchor is exposed outwardly of the concrete piece for grasping by a hoist or the like, and a lower anchoring area is embedded in the concrete piece during precasting.

A flat steel anchor of this general type is known, for example, from German Offenlegungsschrift 30 42 329. In the anchor design described in the publication, a hook-shaped bend of the flat steel part engages behind a reinforcing rod, the hook-shaped bend being such that mounting surfaces for the concrete are formed on both sides of the longitudinal axis. These mounting surfaces, however, lie in different planes, so that the dynamic effects on the mounting surfaces are distributed asymmetrically on the two sides of the longitudinal axis. Due to this, bending forces are produced which adversely affect the load-carrying capacity of the flat steel concrete anchor. Because of the shaping of the hook-like bend a reinforcing rod can be accommodated in the curvature of the bend. This rod, however, needs to be fixed by a wire binding, since otherwise the reinforcing rod may slip out of the curvature, leaving the flat steel concrete anchor merely embedded in concrete, but held only inadequately or not held at all by the reinforcing rod. Since, however, a defective securing of the concrete anchor to the finished concrete piece cannot be inspected, defects of this kind have an effect only under strong tensile strain, for example on raising the concrete part, which then causes considerable danger to constructional personnel and considerable damage to building components and equipment.

SUMMARY OF THE INVENTION

In contrast to the described prior art, the present invention provides a flat steel anchor of the type mentioned constructed in such a way that a reliable cooperation of the reinforcing rod and flat steel anchor is assured without additional securing, and the anchor is optimally free of flexural stresses, even under extremely high load.

The principal advantages of the anchor constructed in accordance with the invention is that the anchoring region of the flat steel anchor surrounds the reinforcement rod completely, or at least to such an extent that the anchor is substantially fixed on the reinforcement rod, and the mounting surfaces on both sides of the axis running through the middle of the height of the anchor are at the same distance from the surface of the finished concrete part, i.e. from the point of suspension on the flat steel anchor.

The hook-shaped ends, which are not merely intended to surround the reinforcement rod, but also form the mounting surfaces, are preferably disposed symmetrically to the half-height axis. The longitudinal slot in the anchoring part can be produced easily by means of a stamping or cutting tool, this operation being able to be carried out at the same time as the preparation of further openings.

A further embodiment of the invention provides that the ends of the two bends are brought into opposite positions at the surfaces formed by the slot, and joined together. Through this a closed ring shape is formed which can surround the reinforcement rod and which also, in particular, reliably withstands extreme forces in the longitudinal direction of the flat steel concrete anchor. A development of this kind may, for example, consist in the ends of the bent sections having recesses or projections and being formed opposite to each other in the axial direction of the reinforcement rod in such a way that the edges formed by the recesses or projections serve as support for the other end in each case. These supports also serve to prevent any crushing of the ring shape, even when an external force acts on the bent sections The recesses or projections are formed in a suitable manner by flat shoulders on the surfaces delimiting the slot.

In accordance with another embodiment of the flat steel anchor, the ends of the hook-shaped bent sections are formed for lifting and extend approximately as far as the outer contour of the curvature of the opposite bent section in each case. Through this measure it is ensured that mounting surfaces for the concrete are formed on both sides of the mid-height axis in two planes, one plane being directly above the reinforcement rod and one plane being directly below the reinforcement rod. In this way the anchoring strength of the flat steel part in the concrete can be even further increased. Although the flat steel is dimensionally stable, provision can be made for a fusion joining of the two ends, in particular by electric welding, as an additional reinforcement measure for the anchoring region.

In accordance with a further embodiment of the flat steel anchor, the bent sections, viewed in the longitudinal direction of the flat steel part, have end faces with a right-angled section and an oblique section, the right-angled sections of the two ends being opposite to each other and separated by a short distance, and the oblique sections forming projecting points. Since the two bent sections are opposite to each other and a short distance apart and the corresponding surfaces come to lie opposite to each other on the action of a force from the exterior, a crushing of the ring shape is avoided, so that the opening through which the reinforcement rod is passed is reliably preserved. Through the projecting points, smaller support areas located beneath the reinforcement rod are formed in addition to the support areas formed above the bent sections. If necessary, further openings of an additional reinforcement rod or bonding iron may be provided.

BRIEF DESCRIPTION OF THE DRAWINGS

Embodiments of the flat steel anchor in accordance with the invention are explained in detail below with reference to the drawings, in which.

DETAILED DESCRIPTION OF THE PREFERRED EMBODIMENTS

Figure 1:
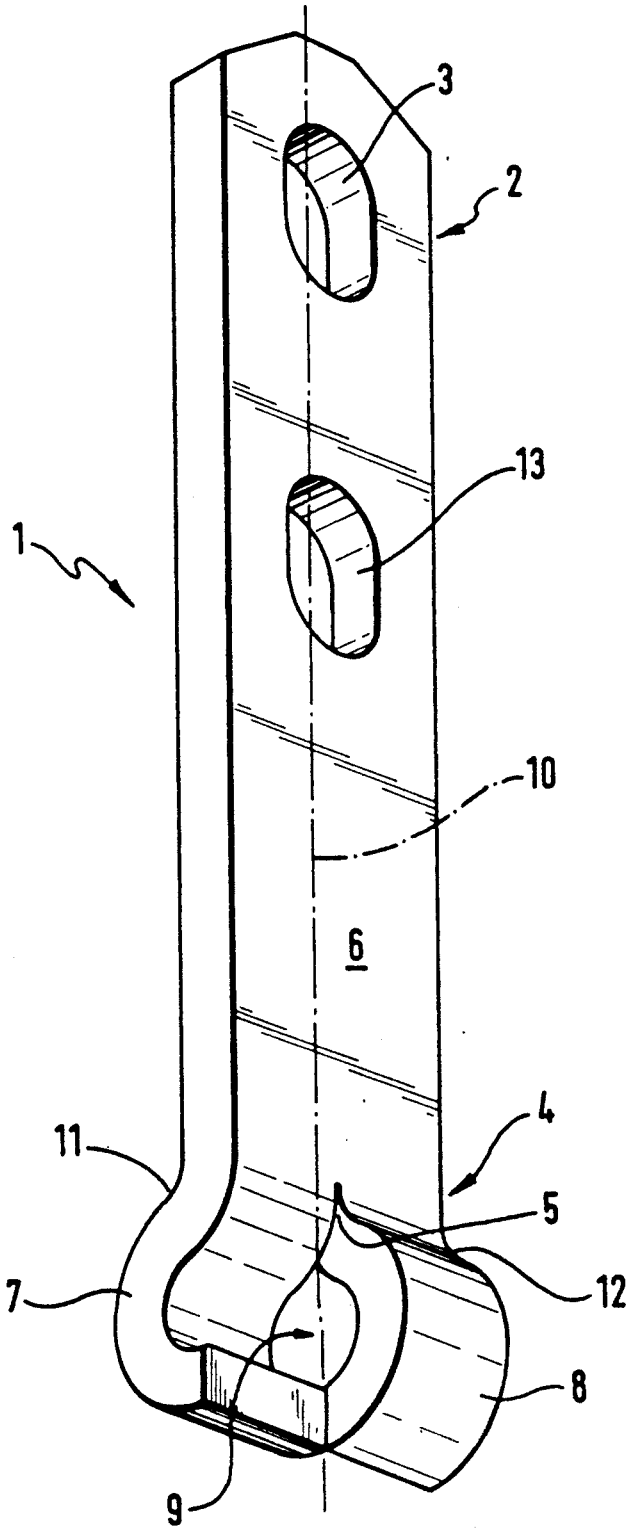
FIG. 1 shows a perspective view of a first embodiment of the flat steel anchor.

FIG. 1 shows a flat steel anchor 1 for precast concrete pieces which has at the upper end a connection area 2 with an opening 3 for receiving a hoist device (which is not shown in the, drawing). An anchoring region 4 forms the lower part of the anchor. In the anchoring region 4 the concrete anchor 1 in the form of a flat steel part 6 is provided with a slot 5 which may be produced, for example, by a cutting or stamping tool. The lower end of the flat steel part 6 on both sides of the slot 5 is formed with hook-shaped bent sections 7 and 8, which are disposed counter to each other, with each section being in the form of a semicircle. In this way, the hook-shaped ends 7 and 8 together form a circular eye 9.

Through the eye 9 a reinforcement rod for a precast concrete part can be passed, on which the flat steel anchor 1 is held securely before the concrete is poured into the formwork. The bent sections 7 and 8 provide support surfaces 11 and 12, respectively, on which the concrete settles, with the sections being distributed on both sides of a mid-height axis 10 positioned in a plane intermediate the front and rear faces of the anchor (see FIG. 3*b*). Since the support surfaces 11 and 12 are disposed on both sides of the mid-height axis, a symmetrical loading of the flat steel part 6 in the withdrawing direction is produced, so that no bending strain occurs, even with high tensile forces. Between the connection area 2 and the anchoring area 4 there is an opening 13 through which a further reinforcement rod or a bonding iron can be passed.

Figure 2:
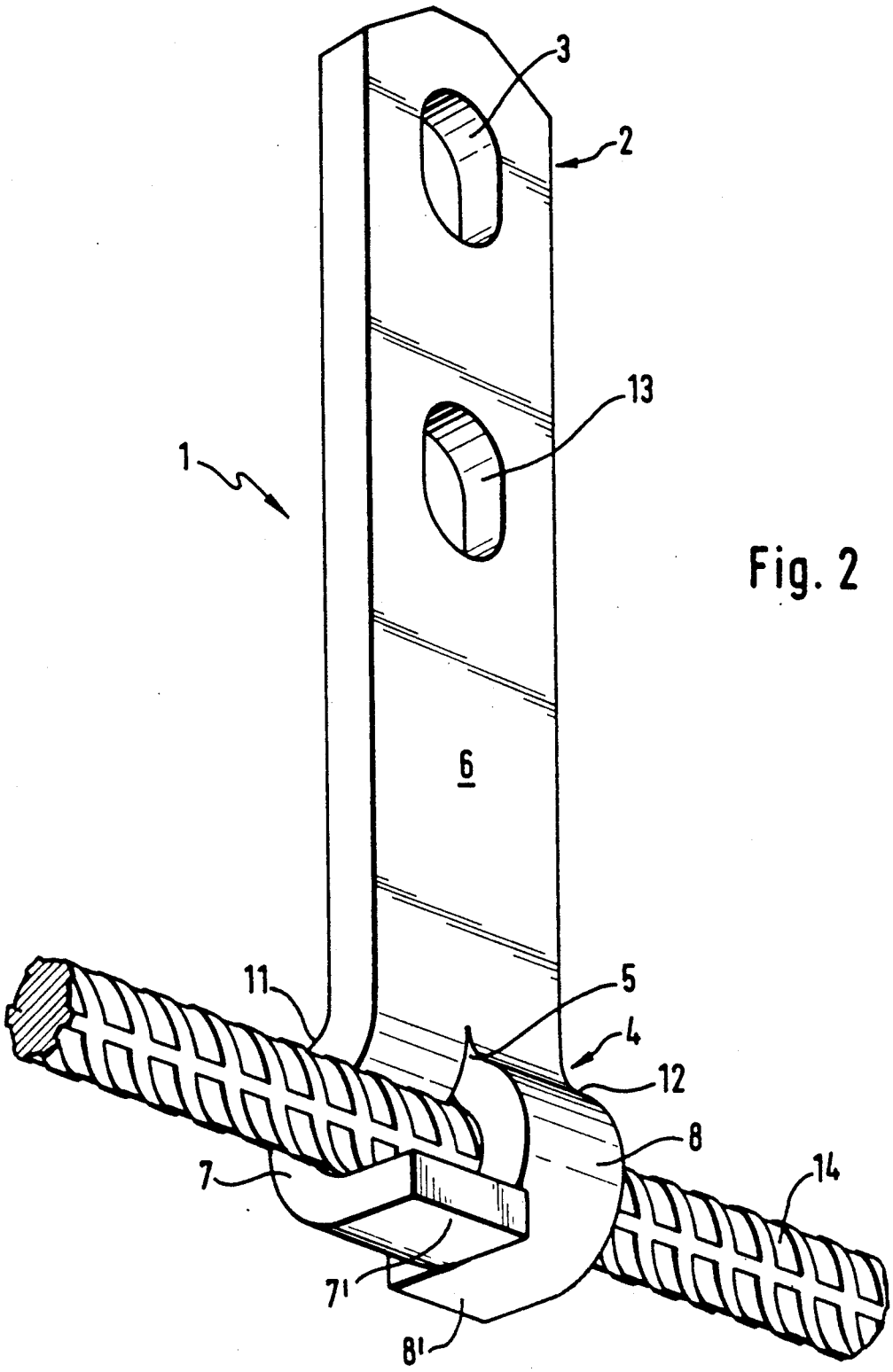
FIG. 2 shows a further embodiment of the flat steel anchor, with a reinforcement rod.

A further embodiment of the flat steel anchor 1 consisting of a flat steel part 6 is shown in FIG. 2. The FIG. 2 is similar in many respects to FIG. 1, and the reference numbers have been used to represent similar parts. The hook-shaped bent sections 7 and 8 in the anchoring region 4 of the FIG. 2 embodiment surround a reinforcement rod 14, the bent sections 7 and 8 having ends 7' and 8' which are smooth and in each case extend as far as the outer contour of the curvature of the bent section disposed opposite. In this way, additional support surfaces for the concrete are produced, which can be seen clearly in FIG. 3*b* in which the support surfaces are indicated by reference numerals 15 and 16.

Figure 3A:
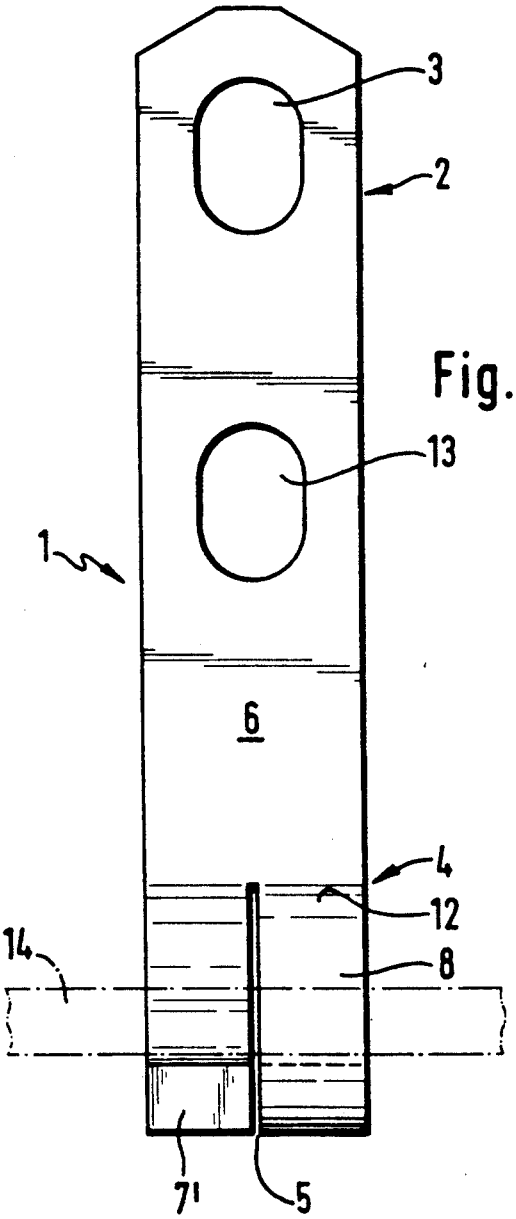
FIGS. 3*a* to 3*c* show a front elevation, side elevation and plan view of the flat steel anchor shown in FIG. 2.
Figure 3B:
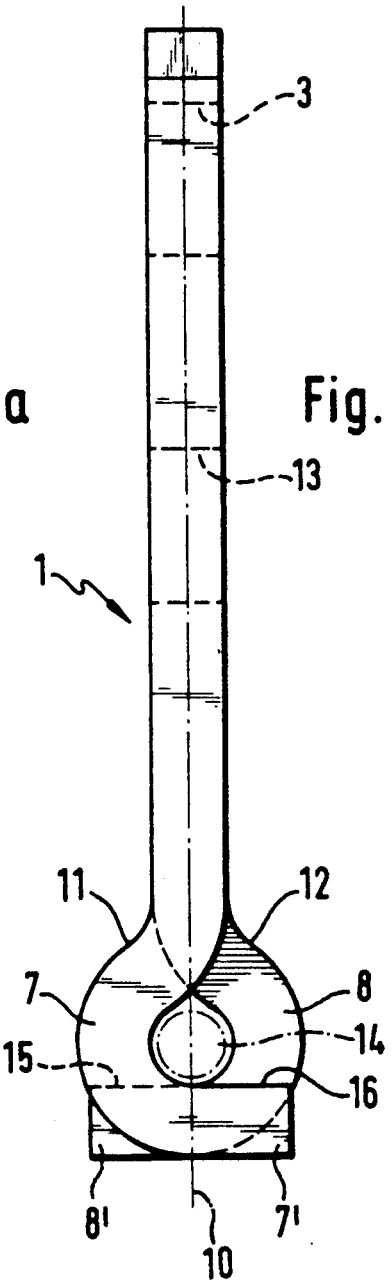
Figure 3C:
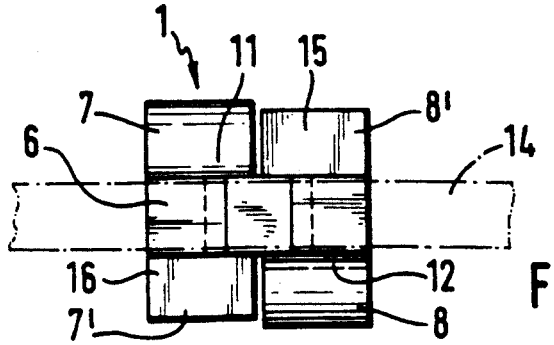

FIG. 3*a* to 3*c* comprise a front elevation, a side elevation and a plan view, respectively, of the flat steel anchor 1 constructed in accordance with FIG. 2. The same reference numerals have been employed for similar parts shown in FIG. 2. The reinforcement rod 14 is indicated by broken lines. It can be seen from FIG. 3*b* that in addition to the support surfaces 11 and 12, support surfaces 15 and 16 are provided located beneath the reinforcement rod 14.

Figure 4:
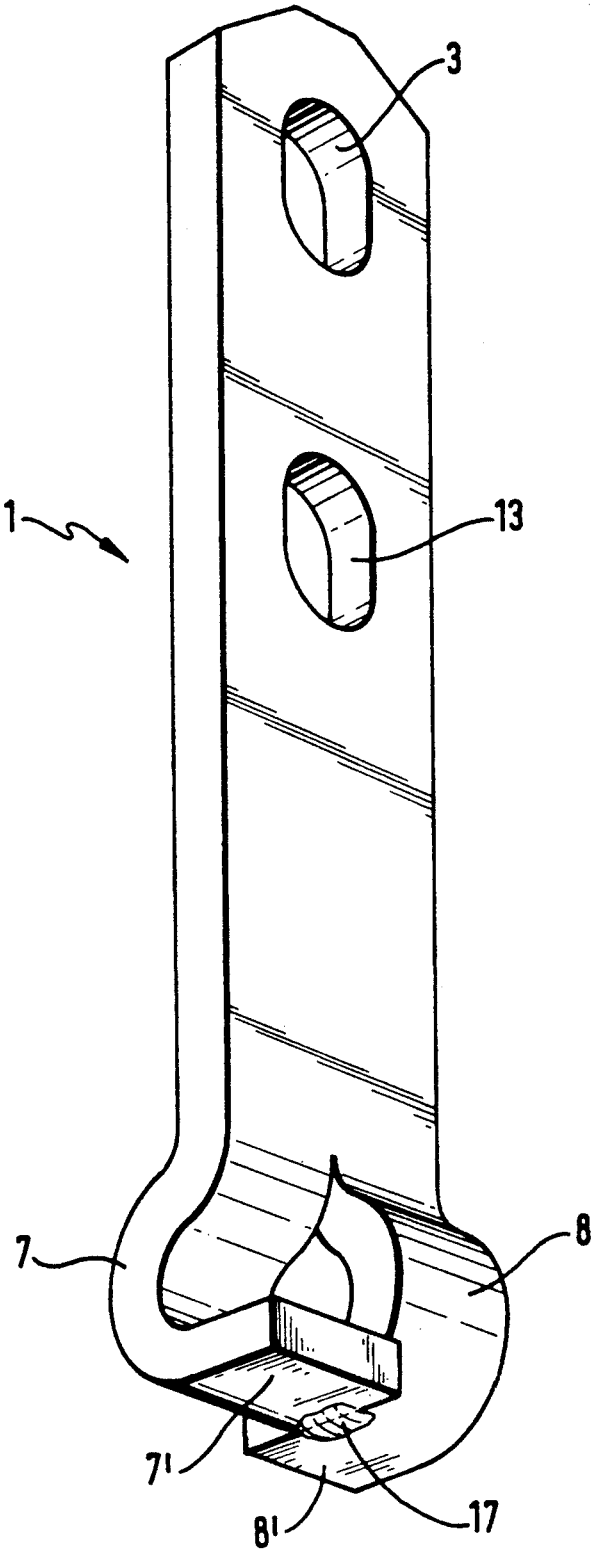
FIG. 4 shows a variant embodiment of the flat steel anchor of FIG. 2, FIGS. 5*a* to 5*c* show a front elevation, side elevation and plan view of a further embodiment, in which the ends of the bent sections are mechanically joined.

FIG. 4 shows a variant embodiment of the flat steel anchor 1 illustrated in FIG. 2, with the FIG. 4 embodiment differing from FIG. 2 only in that the end faces 7' and 8' on the bent sections 7 and 8 are fusibly joined in the area in which these bent sections are adjacent to each other by welded points and a welding seam 17.

Figure 5A:
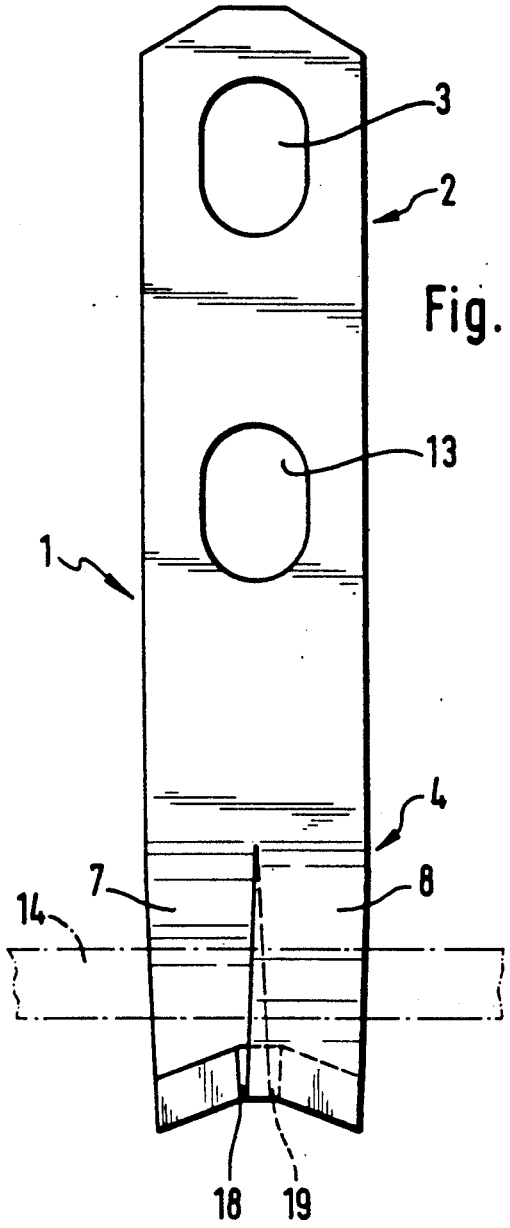
Figure 5B:
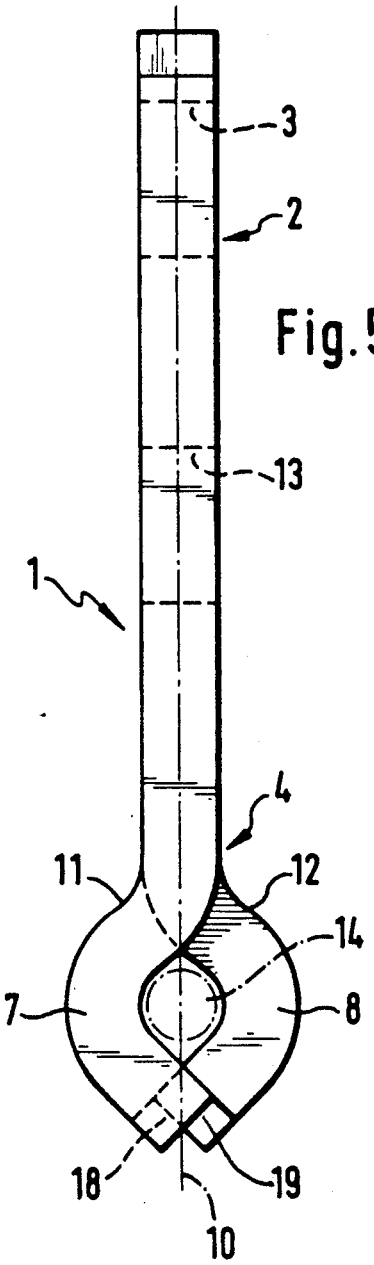
Figure 5C:
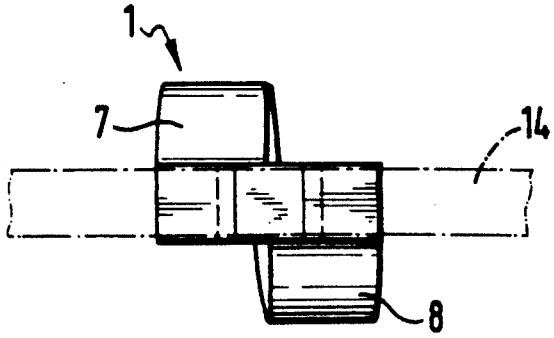

FIGS. 5*a* to 5*c* illustrate a further embodiment of a flat steel anchor, conforming to the FIGS. 1-4 designs with regard to its connection area 2. The anchoring region 4 again has the two hook-shaped bent sections 7 and 8 which surround the reinforcement rod 14. However, the sections 7 and 8 are provided at their ends with flat shoulders 18 and 19, respectively. The bent sections 7 and 8, viewed in the longitudinal direction of the reinforcement rod 14, are shaped to meet head-on, with the end of the bent section 7 coming to lie adjacent the shoulder 19 of the bent section 8, and the end of the bent section 8 coming to lie adjacent the shoulder 18 of the bent section 7.

The flat shoulders 18 and 19 thus form supports for the two bent sections 7 and 8 when viewed both in the axial direction of the reinforcement rod and the bend direction of the bent sections 7 and 8.

Figure 6:
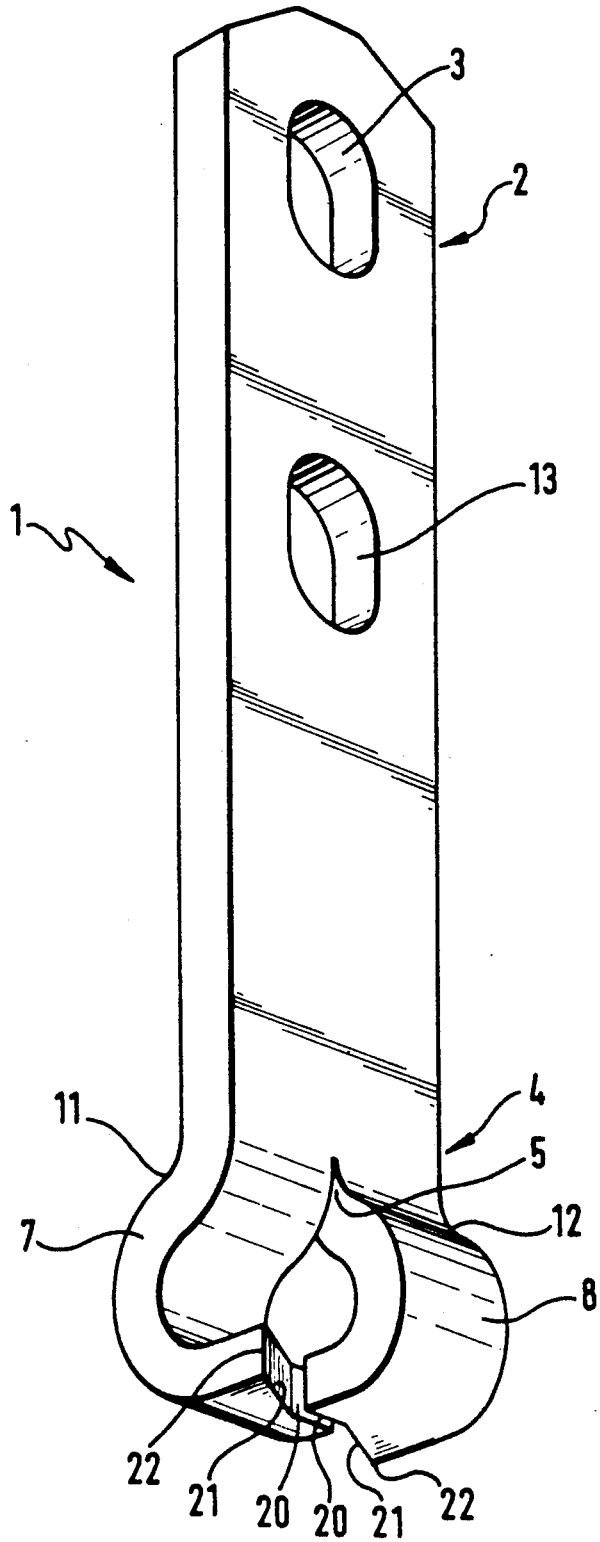
FIG. 6 shows a further variant of the anchor shown in FIG. 2.

FIG. 6 shows a flat steel anchor with the same connecting area 2 as in those described in FIG. 1 to 5. The embodiment of FIG. 6 differs from the previous embodiments in the configurations of the ends of the bent sections 7 and 8 in the anchoring region. The ends are provided with sections 20 running partly at right angles to the longitudinal axis of the bent sections 7 and 8 in that region, with the sections 20 being opposite to each other and a short distance apart, and sections 21 running obliquely. The sections 21 terminate in projecting points 22, and the projecting edges of the sections 21 partially grip the reinforcement rod and form additional anchorages in the concrete.

What is claimed is:

1. A flat steel anchor for precast concrete parts in which the anchor is formed with a connecting area at the top thereof and an anchoring area adjacent the bottom thereof adapted to be embedded in the precast concrete part, said anchor having front and rear faces, and said anchoring area including at least one bent section directed transversely to a longitudinal axis coincident with a longitudinal plane through the anchor intermediate the front and rear faces thereof, said bent section providing a support surface for the concrete and an open area for a reinforcement rod, the improvement comprising:

at least two transversely spaced, hook-shaped bent sections formed in the anchoring area and extending in opposite directions generally perpendicular to said axis, each of said bent sections being curved outwardly away from said axis, then downwardly and inwardly so as to define a curved opening having an axis generally perpendicular to said longitudinal axis, the curved openings of said transversely spaced bent sections, when viewed from the axes of said openings, cooperating to form a continuous opening to receive a reinforcing rod, the oppositely disposed bent sections retaining such rod in said continuous opening.

2. The flat steel anchor as in claim 1, characterized in that the hook-shaped bent sections are disposed symmetrically in relation to said longitudinal axis.

3. The flat steel anchor as in claim 1, characterized in that said anchoring area is provided with a longitudinal slot located and dimensioned so that said transversely spaced bent sections are formed approximately equal in size.

4. The flat steel anchor as in claim 3, characterized in that said two bent sections are formed with ends which are brought into contact at the surfaces thereof formed by the slot and are joined together.

5. The flat steel anchor as in claim 4, characterized in that the ends of the bent sections have slat shoulders and are deformed with respect to each other, as seen in the axial direction of said reinforcing bar, such that said shoulders lie opposite each other in such a way that each shoulder forms an abutment for the adjacent end of the other bent section.

6. The flat steel anchor as in claim 1, characterized in that the ends of the hook-shaped bent sections are smooth and extend approximately as far as the outer contour of the curvature of the opposite bent section.

7. The flat steel anchor as in claim 6, characterized in that the ends of the bent sections are joined by fusion.

8. The flat steel anchor as in claim 1, wherein the ends of said bent sections each comprise a flat surface generally parallel to said longitudinal axis and an oblique section extending laterally from said flat section, said sections being deformed with respect to each other, as seen in the axial direction of said reinforcing bar, in such a way that said flat sections lie opposite each other a small distance apart, and said oblique sections form projecting tips.

9. The flat steel anchor as in claim 1, characterized in that at least one opening is provided between the connecting area and securing area for receiving a further reinforcement rod.

* * * * *